US009237792B2

(12) United States Patent
Sasaki

(10) Patent No.: US 9,237,792 B2
(45) Date of Patent: Jan. 19, 2016

(54) COSMETIC CONTAINER

(71) Applicant: TOKIWA CORPORATION, Gifu (JP)

(72) Inventor: Arata Sasaki, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 0 days.

(21) Appl. No.: 14/470,187

(22) Filed: Aug. 27, 2014

(65) Prior Publication Data

US 2015/0068550 A1 Mar. 12, 2015

(30) Foreign Application Priority Data

Sep. 9, 2013 (JP) ..... 2013-186155

(51) Int. Cl.

| | |
|---|---|
| ***A45D 33/22*** | (2006.01) |
| ***A45D 33/00*** | (2006.01) |
| ***B65D 43/26*** | (2006.01) |
| ***A45D 40/22*** | (2006.01) |

(52) U.S. Cl.

CPC ..... *A45D 33/008* (2013.01); *A45D 40/222* (2013.01); *B65D 43/26* (2013.01); *A45D 2040/223* (2013.01)

(58) Field of Classification Search

CPC ... A45D 33/00; A45D 33/003; A45D 33/006; A45D 33/008; A45D 33/025; A45D 33/16; A45D 34/00; A45D 40/22; A45D 40/221; A45D 40/222; A45D 40/24; A45D 2040/225; A45D 2040/226; A45D 2040/227; A45D 2040/228; A45D 2200/051; A45D 42/02; A45D 2040/223; A45C 11/008; B65D 45/18; B65D 45/025; B65D 45/04; B65D 45/06; B65D 45/12; B65D 45/14; B65D 45/16; B65D 45/20; B65D 45/28; B65D 45/30; B65D 45/34; B65D 43/26; B65D 43/265; B65D 43/267; B65D 2001/1653; B65D 2543/00888; B65D 2543/00907

USPC ..... 132/295, 286, 293, 294, 297, 301, 303, 132/305, 314, 315, 316; 206/581, 823, 235; 16/224, 233, 343

See application file for complete search history.

(56) References Cited

U.S. PATENT DOCUMENTS

| | | | | | |
|---|---|---|---|---|---|
| 4,799,503 | A | * | 1/1989 | Tahara | 220/260 |
| 4,834,122 | A | * | 5/1989 | Yuhara et al. | 132/301 |
| 4,901,882 | A | * | 2/1990 | Goncalves | 220/324 |
| 4,917,131 | A | * | 4/1990 | Contreras, Sr. | 132/301 |
| 4,930,528 | A | * | 6/1990 | Hatakeyama | 132/301 |
| 4,951,692 | A | * | 8/1990 | Yuhara et al. | 132/293 |

(Continued)

FOREIGN PATENT DOCUMENTS

| | | |
|---|---|---|
| JP | 3305890 | 7/2002 |
| JP | 3315818 | 8/2002 |

*Primary Examiner* — Vanitha Elgart

(74) *Attorney, Agent, or Firm* — Greenblum & Bernstein, P.L.C.

(57) ABSTRACT

When a turning portion on the front end side of the cover is turned in one direction, a turning-portion engagement part disposed in the turning portion engages with a container main body-side engagement part so as to close the cover. When the turning portion of the cover is turned in the opposite direction, engagement between the turning-portion engagement part and the container main body-side engagement part is released. When the turning portion is kept turned in the opposite direction, a turning-portion opening-operation auxiliary portion disposed in the turning portion abuts on a container main body-side opening-operation auxiliary portion and the cover can be pressed up with a weak force by the principle of the lever.

9 Claims, 10 Drawing Sheets

(56) References Cited

U.S. PATENT DOCUMENTS

| | | | | | |
|---|---|---|---|---|---|
| 4,972,860 | A | * | 11/1990 | Yuhara et al. | 132/301 |
| 4,989,622 | A | * | 2/1991 | Kozuka et al. | 132/301 |
| 5,050,623 | A | * | 9/1991 | Yuhara et al. | 132/301 |
| 5,232,001 | A | * | 8/1993 | Machelett | 132/293 |
| 5,331,982 | A | * | 7/1994 | Machelett | 132/301 |
| 5,641,065 | A | * | 6/1997 | Owens et al. | 206/370 |
| 5,819,764 | A | * | 10/1998 | Sussman | 132/293 |
| 5,875,795 | A | * | 3/1999 | Bouix | 132/293 |
| 5,887,745 | A | * | 3/1999 | Wood | 220/326 |
| 5,950,638 | A | * | 9/1999 | Crosta | 132/293 |
| 5,950,639 | A | * | 9/1999 | Suzuki et al. | 132/294 |
| 7,090,089 | B2 | * | 8/2006 | Lown et al. | 220/324 |
| 2005/0023183 | A1 | * | 2/2005 | Banik et al. | 206/581 |
| 2007/0181460 | A1 | * | 8/2007 | Young-Kwang | 206/581 |
| 2011/0048451 | A1 | * | 3/2011 | Breese | 132/293 |

* cited by examiner

COSMETIC CONTAINER

TECHNICAL FIELD

The present invention relates to a cosmetic container.

BACKGROUND ART

Conventionally, there is known a cosmetic container referred to as what is called a compact container that houses a powder cosmetic material. In this cosmetic container, in the case where a powder cosmetic material rich in volatility is used, it is necessary to ensure air tightness inside of a container. As a cosmetic container that keeps the air tightness like this, the following container described in Patent Literatures 1 and 2 is known.

The cosmetic container described in Patent Literatures 1 and 2 includes a body container that houses a cosmetic dish filled with a cosmetic material and a cover that is pivotally attached to the back portion of this body container to be openable/closable. An engagement member is pivotally attached to the front portion of the cover to be turnable, and a hook piece that engages with the engagement member is disposed on the front lower surface of the body container. A user can close the cover so as to turns the engagement member to be engaged with the hook piece. This allows firmly and closely fixing the cover to the body container and causes an elastic body for sealing the cover inner surface to be brought into contact with the top surface in the peripheral edge portion of the cosmetic dish, so as to ensure the air tightness of the region (the cosmetic dish) on the inner side of the elastic body.

Additionally, in the above-described cosmetic container, a lever that can release the engagement of the engagement member and the hook piece is pivotally attached to the engagement member to be turnable. The user can pull or push the lever to turn the lever and presses a part of the lever against the body container to turn the engagement member, so as to simply release the engagement of the engagement member and the hook piece by the action of the lever.

CITATION LIST

Patent Literature

Patent Literature 1: Japanese Patent No. 3305890
Patent Literature 2: Japanese Patent No. 3315818

SUMMARY OF INVENTION

Problems to be Solved by the Invention

Here, in the above-described cosmetic container, in a state where the cover is closed and the engagement member and the hook piece engage with each other, the elastic body for sealing is in close contact with the cosmetic dish and the region on the inner side of the elastic body has a negative pressure (in a reduced pressure state). Accordingly, as described above, the action of the lever facilitates the release of the engagement of the engagement member and the hook piece. However, a problem arises in that the cover has trouble to be opened when the user pulls up the cover to open it after this release of the engagement.

Therefore, it is an object of the present invention to provide a cosmetic container that ensures air tightness when a cover is closed and facilitates opening of the cover.

Solution to Problem

A cosmetic container according to the present invention includes a container main body, a cover, a hinge, a container main body-side close-contact portion, and a cover-side close-contact portion. The container main body includes a housing portion configured to house a cosmetic material. The cover is openable/closable with respect to the container main body. The cover is configured to keep an inside of the container main body airtight. The hinge couples a rear end side of the container main body and a rear end side of the cover together. The hinge is used for opening and closing the cover with respect to the container main body. The container main body-side close-contact portion and the cover-side close-contact portion are disposed in respective portions of a peripheral area of the housing portion and a portion of the cover corresponding to this peripheral area. The container main body-side close-contact portion and the cover-side close-contact portion seal an inside of the container main body and the cover in close contact with one another while the cover is closed with respect to the container main body. At least one of the container main body-side close-contact portion and the cover-side close-contact portion is made of an elastic body. Any one of the container main body and the cover has a turning portion on a front end side of the container main body or the cover. The turning portion is configured to turn around one axis along a front end edge. The turning portion includes a turning-portion engagement part and a turning-portion opening-operation auxiliary portion. The turning-portion engagement part engages with an engagement part disposed at another of the container main body or the cover when the turning portion is turned in one direction so as to close the cover and releases the engagement with the engagement part when the turning portion is turned in an opposite direction from the state. The turning-portion opening-operation auxiliary portion abuts on an opening-operation auxiliary portion disposed at the other of the container main body or the cover so as to press up the cover using a principle of a lever when the turning portion is further turned in the opposite direction after the engagement between the engagement parts is released.

With this cosmetic container, when the cover is turned in the closing direction around the hinge that couples the rear end sides of the container main body and the cover together as the fulcrum and the turning portion disposed at any one of the container main body or the cover is turned in one direction, the turning-portion engagement part disposed in the turning portion engages with the engagement part disposed in the other of the container main body or the cover so as to close the cover. Additionally, the container main body-side close-contact portion in the peripheral area of the housing portion of the container main body and the cover-side close-contact portion are brought into contact with each other and the inside of these is sealed. This allows ensuring air tightness while the cover is closed. When the turning portion is turned in the opposite direction, engagement between the engagement parts is released. When the turning portion is kept turned in the opposite direction, the turning-portion opening-operation auxiliary portion disposed in the turning portion abuts on the opening-operation auxiliary portion disposed in the other of the container main body or the cover and the cover can be pressed up with a weak force by the principle of the lever. This allows facilitating opening of the cover.

Here, the turning portion is preferred to be disposed at the cover. In the case where this configuration is employed, the user can hold and turn the turning portion upward so as to release the engagement between the engagement parts, can continue holding and turning the turning portion so as to press up the cover, and can continuously hold and turn the turning portion so as to open the cover around the hinge as the fulcrum. That is, the sequence of the above-described operations can be performed without changing way one holds the turning portion.

In the configuration where the close-contact portions are in close contact with each other in the up-down direction, variation in contact pressure by pressing of the cover in the up-down direction might occur between: the portion where the cover and the engagement part of the container main body engage with each other in the state where the cover is closed; and the other portion, so as to reduce the adhesion between the close-contact portions. As a result, this might reduce air tightness. Therefore, employing the configuration where the close-contact portions are in close contact with each other in the radial direction of the housing portion allows ensuring adhesion between the close-contact portions irrespective of the variation in contact pressure in the up-down direction by pressing of the cover. As a result, the air tightness can be ensured. In the case where the close-contact portions are thus in close contact with each other in the radial direction, the cover-side close-contact portion moves upward in close contact with the container main body-side close-contact portion in the radial direction when the cover is opened. Accordingly, the close contact between the close-contact portions is not immediately released. However, as described above, the cover is pressed up using the principle of the lever. This allows facilitating opening of the cover.

In the case where the turning portion droops downward when the cover is closed, the turning portion interposes between the container main body and the cover, thus hindering closing of the cover. Therefore, providing the stopper that holds the turning portion not to turn downward when the cover is closed from the opening state allows this stopper to hold the turning portion not to turn downward. Accordingly, the turning portion does not enter into between the container main body and the cover to hinder closing of the cover. This allows facilitating closing of the cover.

Advantageous Effects of Invention

Thus, the present invention allows ensuring air tightness while the cover is closed and facilitating opening of the cover.

DESCRIPTION OF EMBODIMENTS

Figure 1:
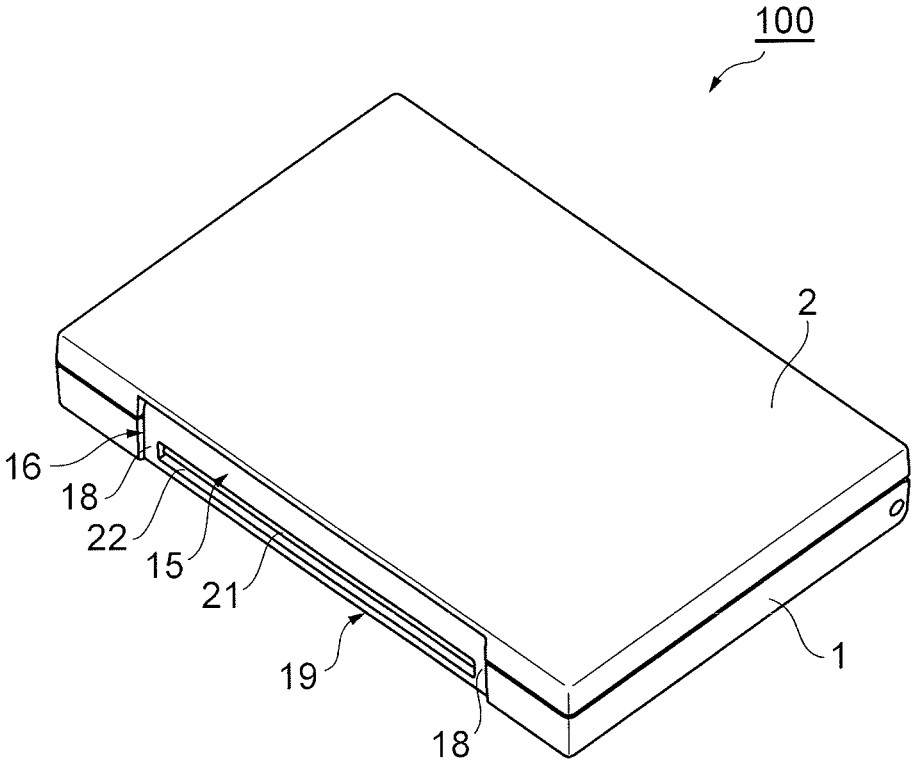
FIG. 1 is a perspective view illustrating a cosmetic container according to an embodiment of the present invention, and is a perspective view illustrating a state where a cover is closed.
Figure 2:
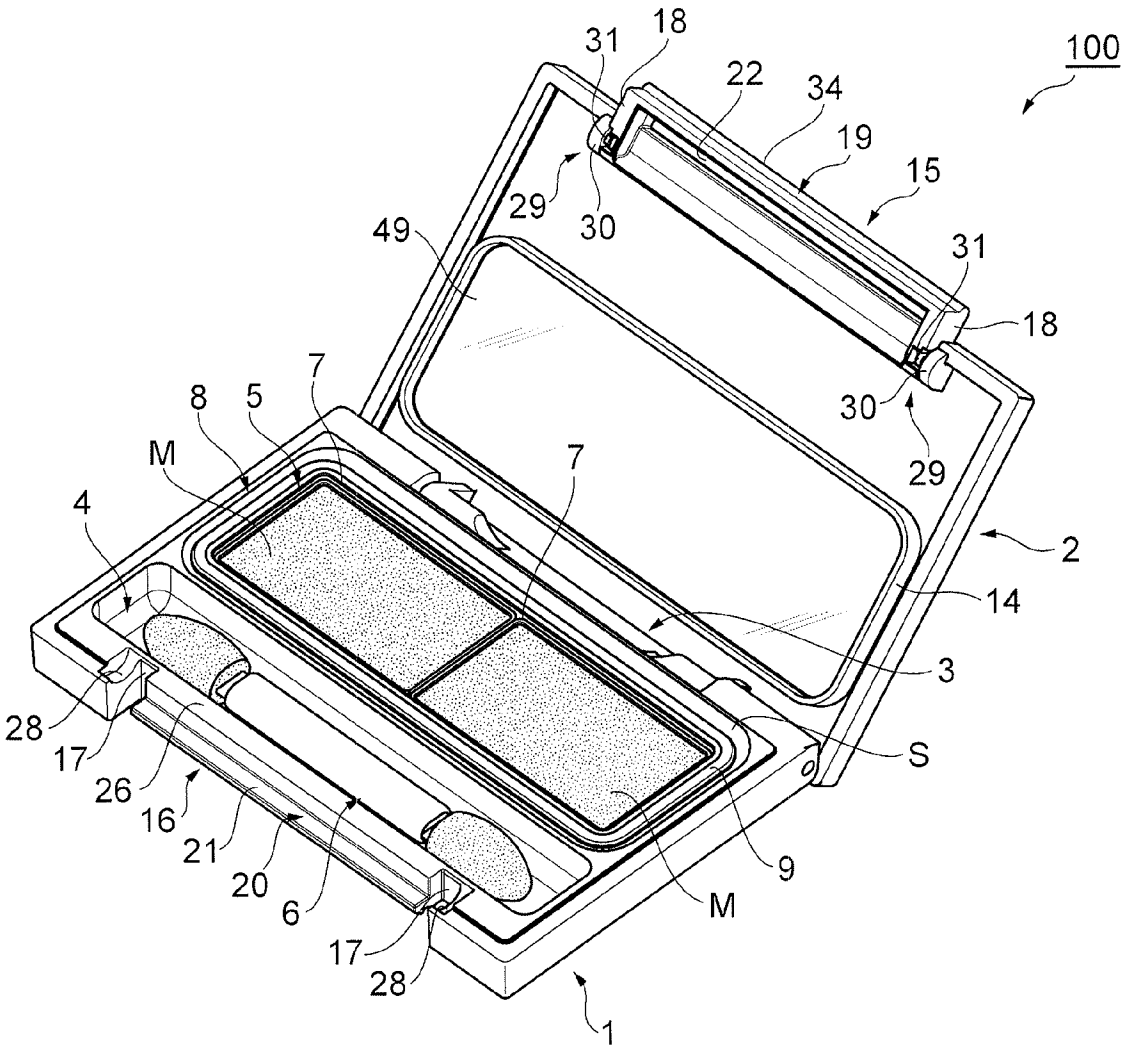
FIG. 2 is a perspective view illustrating a state where the cover is opened form the state in FIG. 1.
Figure 3:
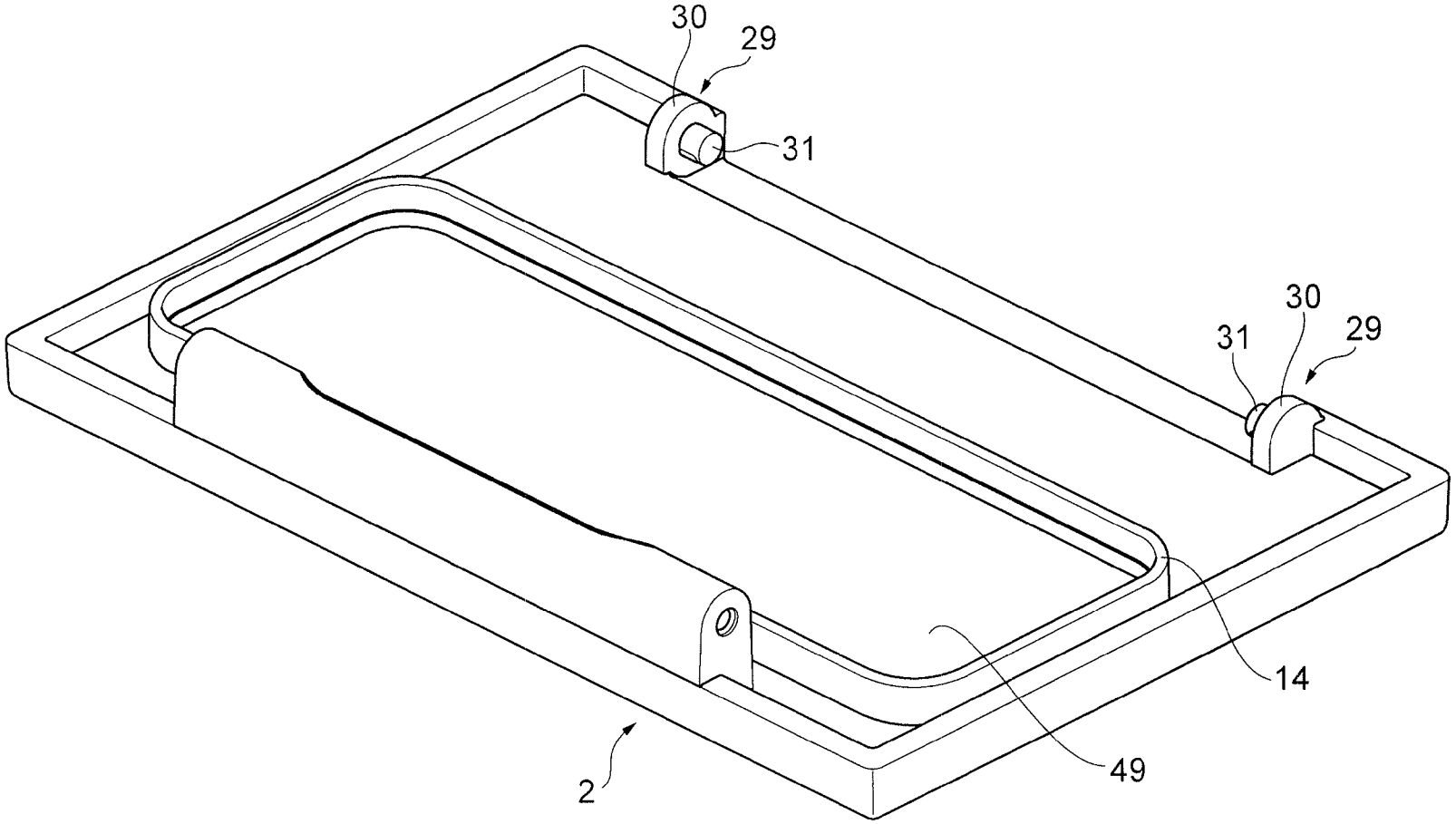
FIG. 3 is a perspective view illustrating the cover in FIG. 2, and is a perspective view illustrating a state where a turning portion is removed.
Figure 4:
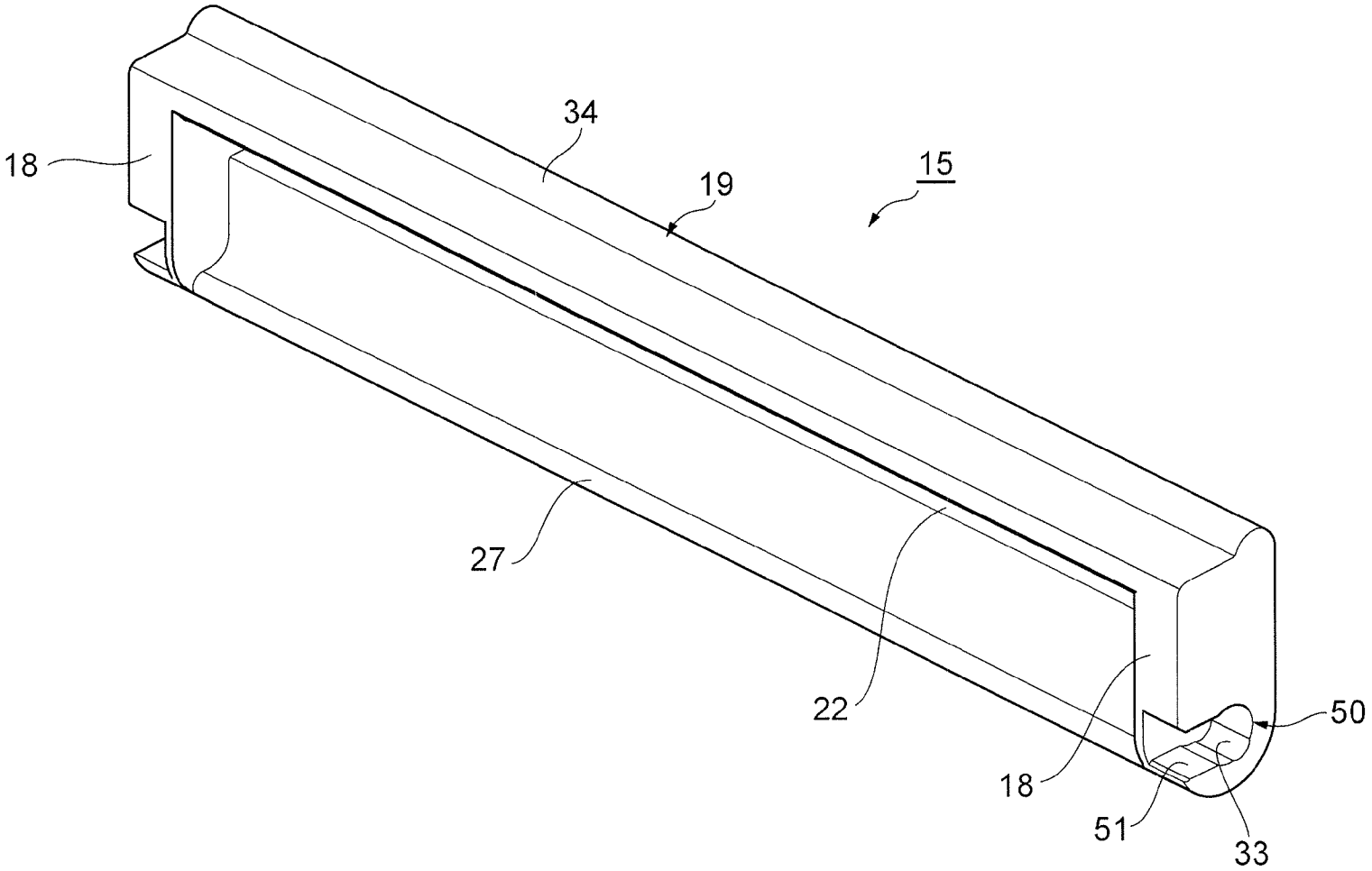
FIG. 4 is a perspective view illustrating the turning portion in FIG. 2.
Figure 5:
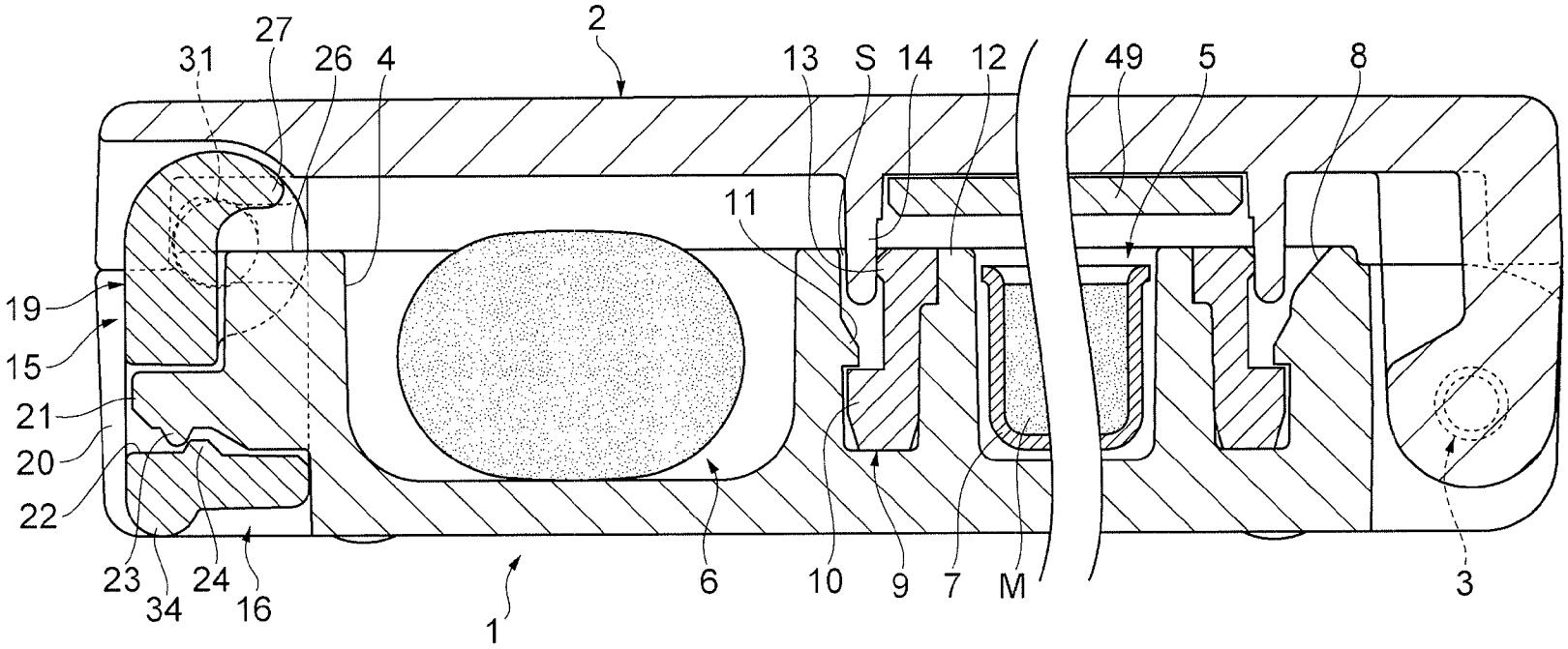
FIG. 5 is a cross-sectional view illustrating a state where the cover of the cosmetic container is closed and engagement parts engage with each other.
Figure 6:
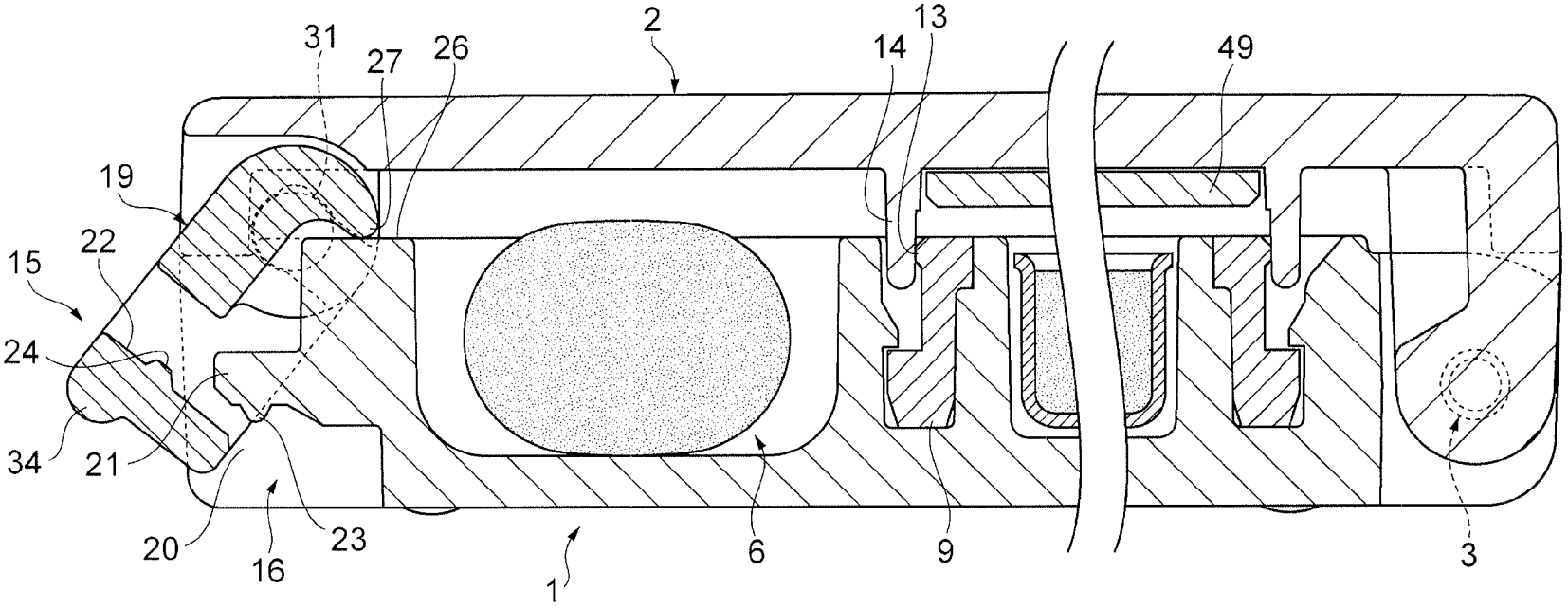
FIG. 6 is a cross-sectional view illustrating a state where the turning portion is turned from the state illustrated in FIG. 5 and the engagement between the engagement parts is released.
Figure 7:
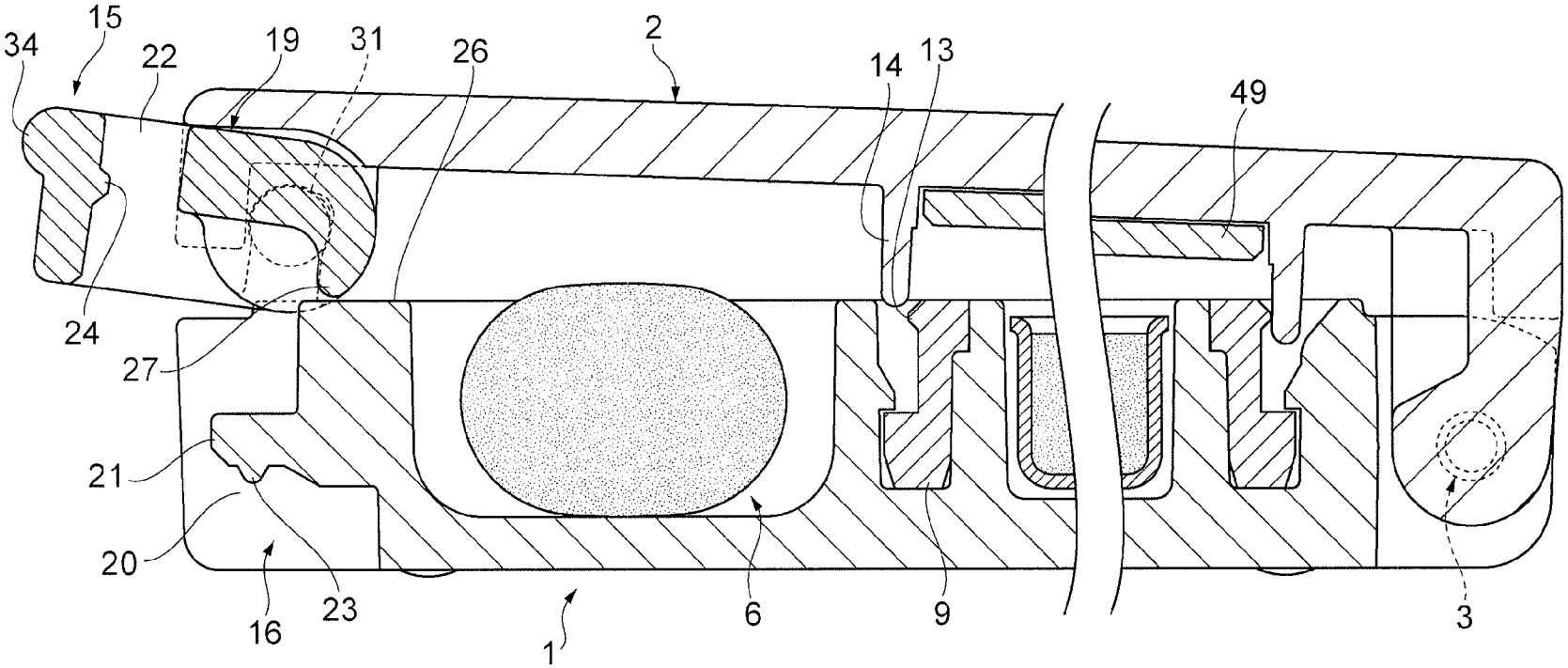
FIG. 7 is a cross-sectional view illustrating a state where the turning portion is further turned from the state illustrated in FIG. 6 and the cover is pressed up by a turning-portion opening-operation auxiliary portion.
Figure 8:
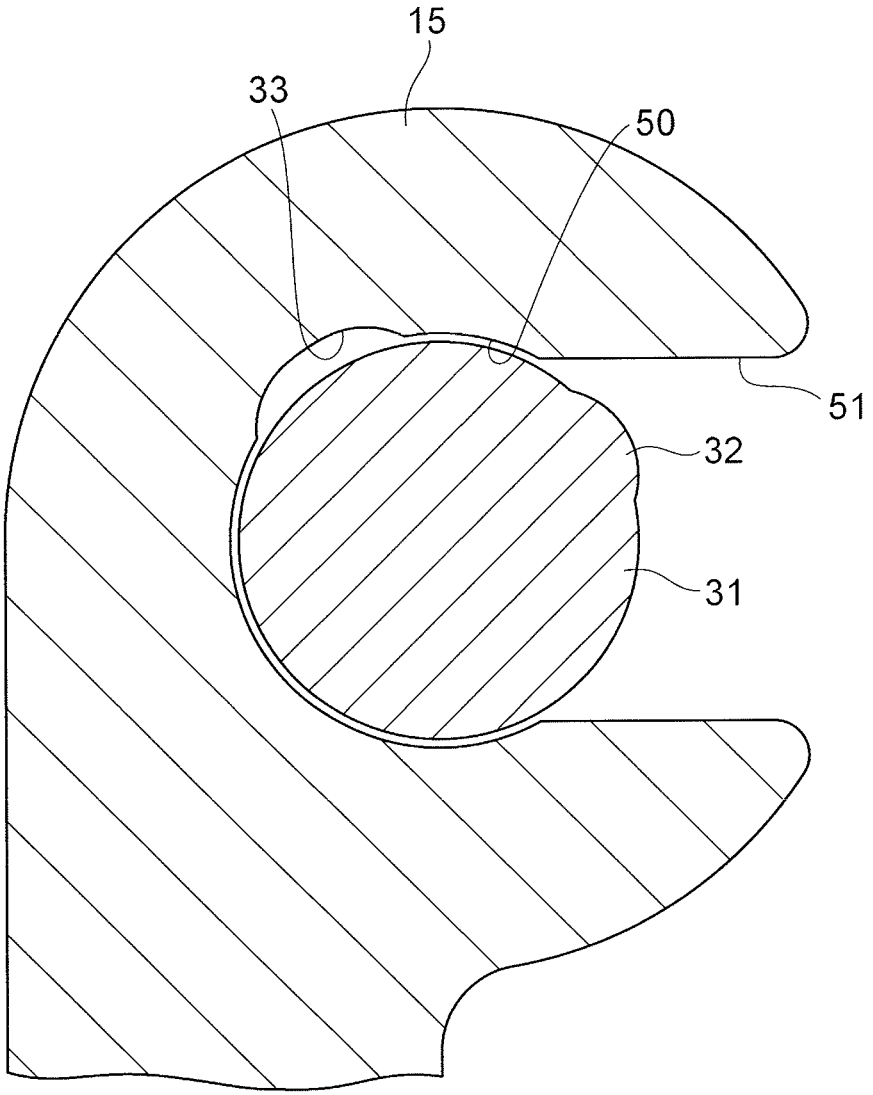
FIG. 8 is an enlarged cross-sectional view illustrating a state of a stopper in the state of FIG. 5.
Figure 9:
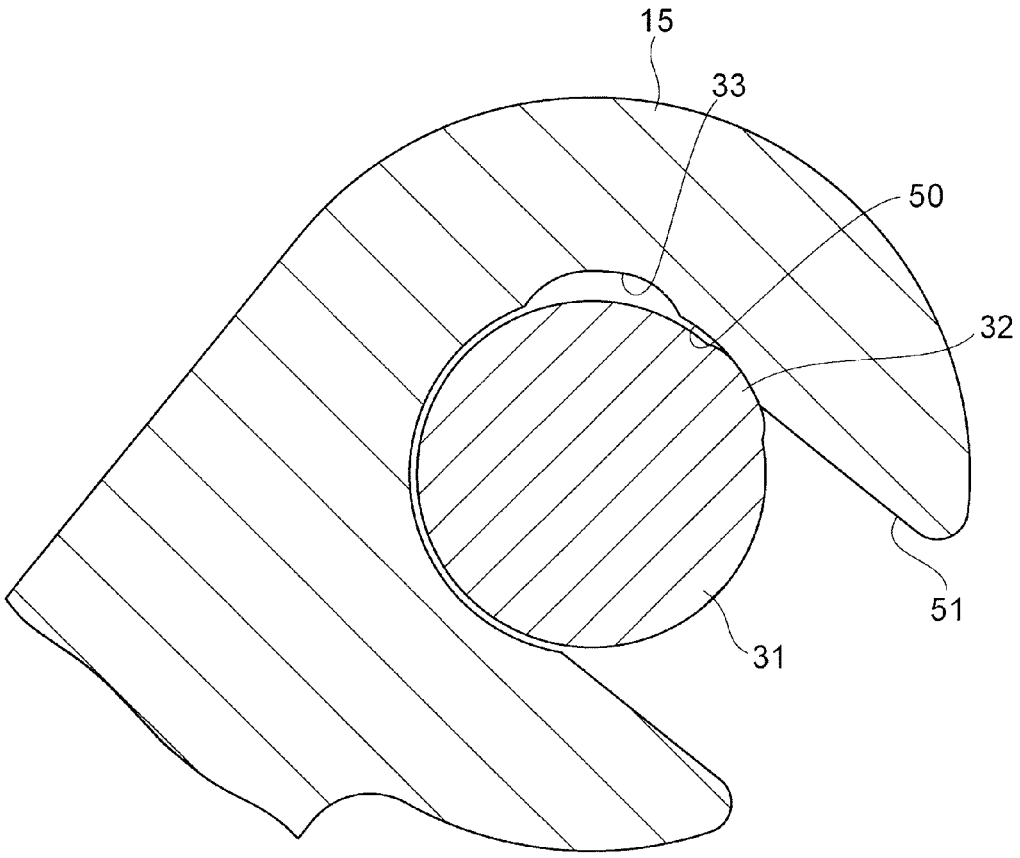
FIG. 9 is an enlarged cross-sectional view illustrating a state of the stopper in the state of FIG. 6.
Figure 10:
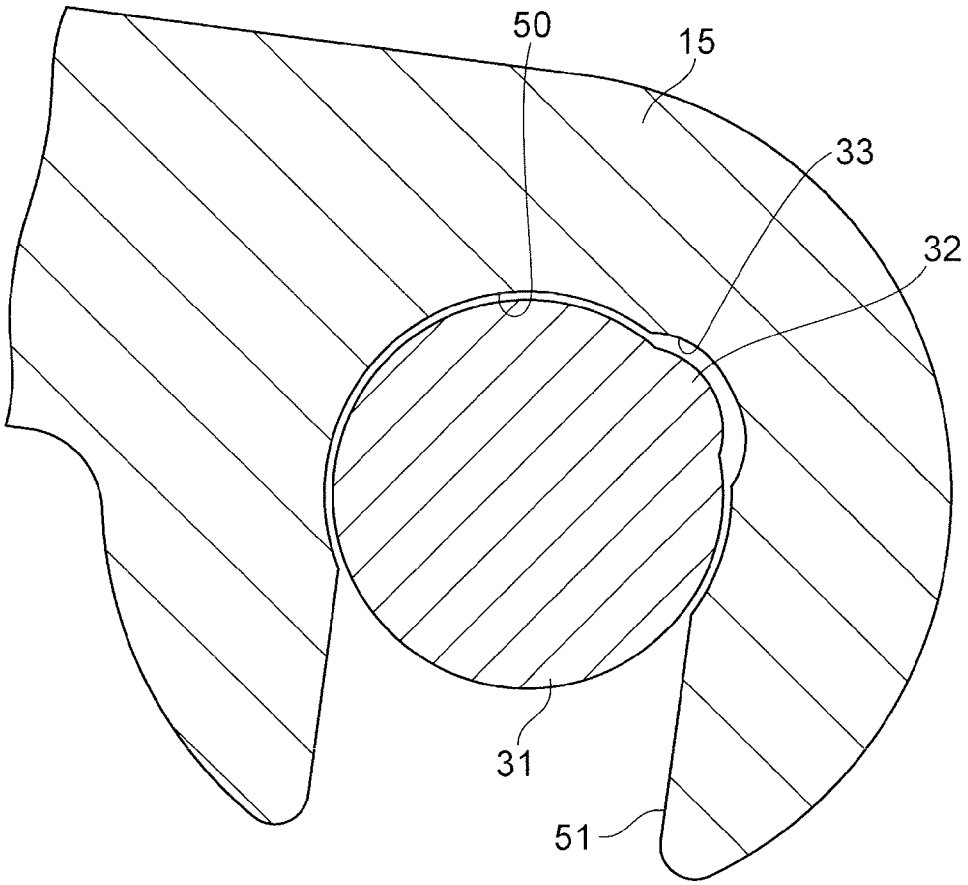
FIG. 10 is an enlarged cross-sectional view illustrating a state of the stopper in the state of FIG. 7.

The following describes the embodiment of the present invention in detail with reference to the accompanying drawings. FIG. 1 and FIG. 2 are respective perspective views illustrating a cosmetic container. FIG. 3 and FIG. 4 are respective perspective views illustrating a cover. FIG. 5 to FIG. 7 are respective state diagrams in which a turning portion of the cover of the cosmetic container is being turned. FIG. 8 to FIG. 10 are respective state diagrams of a stopper corresponding to FIG. 5 to FIG. 7. The cosmetic container of this embodiment is a compact container for housing a cosmetic material and put the cosmetic material on a face or similar part.

As illustrated in FIG. 1 and FIG. 2, a cosmetic container 100 includes a container main body 1 that houses a cosmetic material M and a cover 2 that covers this container main body 1 from upward and keeps the inside of the container airtight. These container main body 1 and cover 2 are, for example, each formed by resin such as ABS in a rectangular shape. As illustrated in FIG. 2, the rear end side of the container main body 1 and the rear end side of the cover 2 are coupled by a hinge 3 (see FIG. 5) such that the cover 2 is openable/closable with respect to the container main body 1.

The container main body 1 includes respective concave portions 4 and 5 depressed downward on the front side and on its rear side. These concave portions 4 and 5 sufficiently extend in the width direction along the front end edge and the back end edge of the container main body 1. The concave portion 4 on the front side houses an applicator 6. The applicator 6 includes, on its both ends, an application body for attaching the cosmetic material M and applying the cosmetic material M over the face.

The concave portion 5 on the rear side is a housing portion for housing the cosmetic material M. Here, inside dishes 7 and 7 filled with the cosmetic material M are housed.

The cosmetic material M is a cosmetic material rich in volatility. Here, a powder cosmetic material is used. Here, the cosmetic material M can employ a solid cosmetic material or a semisolid cosmetic material, additionally, can employ a paste-like or gel-like cosmetic material or similar cosmetic material.

In the peripheral area that surrounds the concave portion 5, as illustrated in FIG. 2 and FIG. 5, a concave portion 8 that has a rectangular ring shape in plan view is formed. Within the concave portion 8, an elastic body 9 that has a rectangular ring shape in plan view is arranged. The elastic body 9 employs a rubber seal that is preferred in particular here. For example, an elastic body such as a sponge in a foam may be used. The elastic body 9 is preferred to be an elastic body that can keep high air tightness by close contact.

The elastic body 9 includes, as illustrated in FIG. 5, a collar portion 10 that has a rectangular ring shape in plan view and projects outward in the lower end portion of the elastic body 9. Additionally, on the upper outer peripheral surface of the elastic body 9, a convex portion (container main body-side close-contact portion) 13 that has a rectangular ring shape in plan view and projects outward is disposed to be brought into close contact with a resin projection (cover-side close-contact portion) 14 on the back surface of the cover 2 in the radial direction when this cover 2 is closed.

The elastic body 9 faces a convex portion 11 that has a rectangular ring shape in plan view and projects to the inner side such that the bottom surface of the collar portion 10 of the elastic body 9 abuts on the bottom surface of the concave portion 8 of the container main body 1 and the top surface of the collar portion 10 of the elastic body 9 is disposed in the container main body 1 to be positioned on the collar portion 10. Additionally, the inner peripheral surface of the elastic body 9 is brought into close contact with the outer peripheral surface of a convex portion 12 that is formed between the concave portion 5 and the concave portion 8 of the container main body 1 and has a rectangular ring shape in plan view so as to be mounted on the container main body 1.

On the outer periphery side of the elastic body 9 in the upper portion within the concave portion 8 of the container main body 1, a gap S is disposed for entrance of the resin projection 14 on the back surface of the cover 2 when this cover 2 is closed.

In the forward end portion of the container main body 1, in the position except both end portions, as illustrated in FIG. 1, FIG. 2, and FIG. 5 to FIG. 7, a concave portion 16 that is depressed in a depth direction (a front-rear end direction perpendicular to the width direction) of the container main body 1 and is opened to the front side, the upper side, and the lower side is formed so as to cause entrance of a turning portion 15 in the center of the forward end portion of the cover 2 by turning when this cover 2 is closed. Both ends of this concave portion 16 extending in the width direction are formed as respective concave portions 17 (see FIG. 2) depressed so as to cause entrance of both end portions 18 of the turning portion 15 by turning when the cover 2 is closed. The portion between these respective concave portions 17 and 17 is formed as a concave portion 20 depressed so as to cause entrance of a center portion 19 of the turning portion 15 except both the end portions 18 and 18 by turning when the cover 2 is closed.

On the front end surface that forms this concave portion 20, a projecting portion 21 that projects forward from approximately the center of the up-down direction of the front end surface is formed to extend in the width direction. This projecting portion 21 enters an intermediate window 22 of the turning portion 15. On the inferior surface of the projecting portion 21, a protrusion (container main body-side engagement part) 23 is disposed to extend in the width direction. This protrusion 23 is disposed to be engaged with a protrusion (turning-portion engagement part) 24 of the turning portion 15 of the cover 2 when this cover 2 is closed. A top surface 26 of the portion that is positioned on the front side of the concave portion 4 on the front side of the container main body 1 and positioned on the rear side of the projecting portion 21 is formed as a container main body-side opening-operation auxiliary portion abutting on a convex portion 27 that is a turning-portion opening-operation auxiliary portion of the turning portion 15.

Here, a semicircular concave portion 28 (see FIG. 2) adjacent to the concave portion 16 of the container main body 1 in the width direction is a concave portion for entrance of a receiving portion 30 that constitutes a supporting portion 29 of the cover 2 when this cover 2 is closed.

The cover 2 includes a resin projection 14 that projects from the back surface (the inner surface) of the cover 2 and has a rectangular ring shape in the position corresponding to the peripheral area of the concave portion 5 of the container main body 1, that is, the position corresponding to the elastic body 9. This resin projection 14 is integrally formed with the cover 2, and is brought into close contact with the convex portion 13 of the elastic body 9 from the outside in the radial direction to ensure air tightness when the cover 2 is closed.

Inside of the resin projection 14 that forms the rectangular ring shape in the cover 2, a mirror 49 for reflecting the face is fixed.

On the front end side of the cover 2, the turning portion 15 that can turn around one axis along the front end edge and has approximately the same width as that of the concave portion 16 of the container main body 1 is disposed, and the supporting portion 29 that turnably supports this turning portion 15 is disposed.

As illustrated in FIG. 2 and FIG. 3, the supporting portion 29 is disposed separately in the width direction and functions as a bearing that supports the turning portion 15 on both end sides. This supporting portion 29 includes the receiving portion 30 and a shaft portion 31. The receiving portion 30 has a disk shape with the shaft center along the front end edge of the cover 2, and is integrally formed with the cover 2. The shaft portions 31 project in short length from respective opposing surfaces of these receiving portions 30 and 30 as turning fulcrums that support the end portion 18 of the turning portion 15.

As illustrated in FIG. 8 to FIG. 10, the shaft portion 31 is constituted to have a circular cross section, and includes a convex portion 32 in a part of the outer peripheral surface of the shaft portion 31. The convex portion 32 projects outward having an arc-like cross section and extends in the axial direction. This convex portion 32 circumferentially engages with the concave portion 33 of the turning portion 15.

As illustrated in FIG. 2, FIG. 4, and FIG. 8 to FIG. 10, the turning portion 15 includes openings 50 and 50 that have approximately circular cross sections which the shaft portion 31 enters on both the end portions 18 of the turning portion 15. This opening 50 includes a concave portion 33 that has an arc-like cross section to be circumferentially engaged with the convex portion 32 of the shaft portion 31. These concave portion 33 of the turning portion 15 and convex portion 32 of the shaft portion 31 constitute a stopper for keeping the posture of the turning portion 15 in a predetermined posture.

The opening 50 couples to a passage 51 that communicates with the opening 50 and is opened toward the outside of the end portion 18 so as to allow entrance of the shaft portion 31 of the cover 2 from the radial direction into the opening 50. In a state where the cover 2 is closed (see FIG. 5 and FIG. 8), the passage 51 is opened toward the rear end side of the cover 2. As illustrated in FIG. 4 and FIG. 8, the size (the opening height in the up-down direction in the drawing) of the passage 51 is set to be slightly smaller than the opening 50 and the diameter of the shaft portion 31. Through this passage 51, the shaft portion 31 is pushed from the outside in the radial direction of the opening 50 into this opening 50 so as to be arranged in and enter the opening 50.

As illustrated in FIG. 2 and FIG. 4 to FIG. 7, the center portion 19 except both the end portions 18 and 18 of the turning portion 15 includes the intermediate window 22 that passes through in the depth direction (the right-left direction in FIG. 5) when the cover 2 is closed and that allows entrance of the projecting portion 21 of the container main body 1.

On the inner surface that forms the intermediate window 22 of the turning portion 15 on the far side of the turning fulcrum 31, the protrusion 24 that engages with the protrusion 23 of the projecting portion 21 of the container main body 1 when the turning portion 15 turns around the shaft portion 31 as the turning fulcrum is formed to extend in the width direction. The engagement width of the engagement be these protrusions 23 and 24 is set to about 70 percent of the front end edges of the cover 2 and the container main body 1. Here, the engagement part is set to the protrusion that is preferred in particular. Of course, the engagement part may have another configuration.

On the outer surface of the end portion on the opposite side of the turning fulcrum side of the turning portion 15, a convex portion 34 for, for example, catching a finger such as an index finger and a middle finger so as to turn the turning portion 15 is disposed to extend in the width direction.

Furthermore, the end portion on the turning fulcrum side of the turning portion 15 includes the convex portion 27 that projects toward the rear end side (the right side in FIG. 5) of the cover 2 when this cover 2 is closed and extends in the width direction. This convex portion 27 abuts on the top surface 26 of the container main body 1 after the turning portion 15 is turned to open the cover 2 so as to release the engagement between the protrusions 23 and 24. Additionally, the tip end of the convex portion 27 has a cross section in a rounded R-shape perpendicular to the extending direction.

In the state where the cover 2 is opened (see FIG. 2), as illustrated in FIG. 10, the concave portion 33 circumferentially engages with the convex portion 32 of the shaft portion 31 and then the turning portion 15 is kept in a posture projecting forward from the front end edge of the cover 2 along the cover 2 (see FIG. 2 and FIG. 7).

Next, a description will be given of the operation of the cosmetic container 100 with this configuration. Firstly, as illustrated in FIG. 1, in a state where the cover 2 is closed, as illustrated in FIG. 5, the turning portion 15 is turned downward by approximately 90° with respect to the cover 2. The projecting portion 21 of the container main body 1 enters the intermediate window 22 of the turning portion 15, and the protrusion 23 of the container main body 1 and the protrusion 24 of the turning portion 15 engage with each other in this state. At this time, as illustrated in FIG. 8, the convex portion 32 of the shaft portion 31 of the cover 2 is positioned within the passage 51. The concave portion 33 of the turning portion 15 is in a position shifted counterclockwise in the drawing with respect to this convex portion 32, and does not circumferentially engage with the convex portion 32.

In this state, as illustrated in FIG. 1 and FIG. 5, the projecting portion 21 of the container main body 1 does not project outward from the inside of the intermediate window 22. The surface on the outer side of the turning portion 15 does not project outward from the front end surface on the side of the container main body 1 and cover 2 in appearance.

In this state, as illustrated in FIG. 5, the convex portion 13 of the elastic body 9 of the container main body 1 and the resin projection 14 of the cover 2 are in close contact with each other in the radial direction. The convex portion 13 of the elastic body 9 ensures air tightness of the region (concave portion 5) on the inner side.

Next, in use, the user holds the convex portion 34 of the turning portion 15 with the finger (catches the convex portion 34 with the finger) and pulls the convex portion 34 against the engaging force between the protrusions 23 and 24. Then, turning of the turning portion 15 around the shaft portion 31 as the turning fulcrum releases the engagement between the protrusions 23 and 24 as illustrated in FIG. 6 and causes the convex portion 32 of the shaft portion 31 of the cover 2 to enter the opening 50 of the turning portion 15 turning clockwise in the drawing in a slightly deformed state as illustrated in FIG. 9.

Furthermore, when turning of the turning portion 15 is continued, the convex portion 27 of the turning portion 15 abuts on the top surface 26 as illustrated in FIG. 6. Furthermore, when turning of the turning portion 15 is continued, by the principle of the lever in which the shaft portion 31 is a fulcrum, the convex portion 34 of the turning portion 15 is a point of effort, and the convex portion 27 of the turning portion 15 is a point of load, the cover 2 can be pressed up with a weak force.

At this time, the resin projection 14 moves upward in close contact with the convex portion 13 of the elastic body 9 in the radial direction.

Furthermore, continuing turning of the turning portion 15 releases the close contact between the resin projection 14 and the convex portion 13 of the elastic body 9 as illustrated in FIG. 7 and causes the cover 2 to open. When turning of the turning portion 15 is further continued, the turning portion 15 becomes in an open posture projecting forward from the front end edge of the cover 2 along the cover 2.

At this time, as illustrated in FIG. 10, the convex portion 32 of the shaft portion 31 of the cover 2 enters and circumferentially engages with the concave portion 33 of the turning portion 15 turning clockwise in the drawing. The above-described open posture of the turning portion 15 is kept.

Further continuing turning of the turning portion 15 causes the cover 2 to turn upward that is the opening direction around the hinge 3 as the turning fulcrum. As illustrated in FIG. 2, the cover 2 is set to the maximum open state. The applicator 6 is used to apply the cosmetic material M.

On the other hand, in the case where application of the cosmetic material M is terminated and the cover 2 is closed, the user performs the reverse operation of the operation for opening the above-described cover 2. When this cover 2 is closed, the turning portion 15 maintains the above-described open posture without being turned downward by the stoppers 32 and 33.

Turning the cover 2 in the closing direction while the turning portion 15 maintains the open posture causes the convex portion 27 of the turning portion 15 to abut on the top surface 26 of the container main body 1 as illustrated in FIG. 7. When this state occurs, the turning portion 15 is turned counterclockwise in the drawing with a force larger than the engaging force of the stoppers 32 and 33. Then, after release of the engagement of the stoppers 32 and 33, the turning portion 15 further turns. At this time, the resin projection 14 moves downward in close contact with the convex portion 13 of the elastic body 9 in the radial direction.

Here, when the cover 2 is turned in the closing direction and the convex portion 27 of the turning portion 15 abuts on the top surface 26 of the container main body 1 as illustrated in FIG. 7, the user may press the cover 2 downward with a jerk. Thus, since the tip end of the convex portion 27 has an R-shape, the turning portion 15 naturally turns downward against the engaging force of the stoppers 32 and 33 and then the state illustrated in FIG. 6 is caused. Accordingly, the next turning operation and turning direction of the turning portion 15 can be shown to the user with ease of understanding.

When turning of the turning portion 15 is further continued, the turning portion 15 is turned downward by approximately 90° with respect to the cover 2 as illustrated in FIG. 5, the projecting portion 21 of the container main body 1 enters the intermediate window 22 of the turning portion 15, and the protrusions 23 and 24 engage with each other. Accordingly, the cover 2 becomes the closed state and the resin projection 14 is radially brought into close contact with the convex portion 13 of the elastic body 9 in a predetermined position, so as to ensure air tightness of the region (the concave portion 5) on the inner side of the convex portion 13 of the elastic body 9.

Thus, in this embodiment, when the cover 2 is turned in the closing direction around the hinge 3 that couples the rear end sides of the container main body 1 and the cover 2 together as the fulcrum and the turning portion 15 on the front end side of the cover 2 is turned in one direction (counterclockwise in FIG. 7), the protrusion 24 that is the turning-portion engagement part disposed in the turning portion 15 engages with the protrusion 23 that is the container main body-side engagement part so as to close the cover 2. Additionally, the convex portion 13 that is the container main body-side close-contact portion of the elastic body 9 in the peripheral area of the concave portion 5 of the container main body 1 and the resin projection 14 that is the cover-side close-contact portion of the cover 2 are brought into contact with each other and the inside of these is sealed. This allows ensuring air tightness when the cover 2 is closed.

When the turning portion 15 of the cover 2 is turned in the opposite direction (clockwise in FIG. 5), the engagement between the protrusions 23 and 24 is released. When the turning portion 15 is kept turned in the opposite direction, the convex portion 27 that is the turning-portion opening-operation auxiliary portion disposed in the turning portion 15 abuts on the top surface 26 that is the container main body-side opening-operation auxiliary portion and the cover 2 can be pressed up with a weak force by the principle of the lever. This allows releasing the airtight state and simply opening the cover.

In this embodiment, the turning portion 15 is disposed in the cover 2. Accordingly, the user can hold and turn the turning portion 15 upward so as to release the engagement between the engagement parts 23 and 24, can continue holding and turning the turning portion 15 so as to press up the cover 2, and can continuously hold and turn the turning portion 15 so as to open the cover 2 around the hinge 3 as the fulcrum. That is, the sequence of the above-described operations can be performed without changing way one holds the turning portion 15.

Here, in the configuration where the close-contact portions are in close contact with each other in the up-down direction, variation in contact pressure by pressing of the cover in the up-down direction might occur between: the portion where the cover and the engagement part of the container main body engage with each other in the state where the cover is closed; and the other portion, so as to reduce the adhesion between the close-contact portions. As a result, this might reduce air tightness. However, this embodiment employs the configuration where the resin projection 14 and the convex portion 13 of the elastic body 9 are in close contact with each other in the radial direction. Accordingly, the adhesion between the resin projection 14 and the convex portion 13 of the elastic body 9 in the radial direction can be ensured irrespective of the variation in contact pressure in the up-down direction by pressing of the cover 2. As a result, the air tightness can be ensured. In the case where the resin projection 14 and the convex portion 13 of the elastic body 9 are thus in close contact with each other in the radial direction, the resin projection 14 moves upward in close contact with the convex portion 13 of the elastic body 9 in the radial direction when the cover 2 is opened. Accordingly, the close contact between the resin projection 14 and the convex portion 13 of the elastic body 9 is not immediately released. However, as described above, the cover 2 is pressed up using the principle of the lever. This allows facilitating opening of the cover 2.

In the case where the turning portion 15 droops downward when the cover 2 is closed, the turning portion 15 interposes between the container main body 1 and the cover 2, thus hindering closing of the cover 2. However, this embodiment includes the stoppers 32 and 33 that hold the turning portion 15 not to turn downward when the cover 2 is closed from the opening state. Since these stoppers 32 and 33 hold the turning portion 15 not to turn downward, the turning portion 15 does not enter into between the container main body 1 and the cover 2 to hinder closing of the cover 2. This allows facilitating closing of the cover 2.

In Patent Literatures 1 and 2, the engagement width (the engagement width along the front end edge) of engagement between the hook piece of the body container and the engagement member of the cover is smaller than half of the front end edges of the body container and the cover and set to around ⅓ of the front end edges. In this configuration, even if the engagement member and the hook piece are engaged with each other so as to firmly and closely fix the cover to the body container, the portions on both sides in the engagement width of the cover might be pressed up due to expansion of the internal air and warping might occur. This portion of warping might cause leakage of the air. In this embodiment, the engagement width of engagement between the protrusion 24 and the protrusion 23 (corresponding to the engagement member and the hook piece) is set to around 70 percent of the front end edges of the container main body 1 and the cover 2 and has a high proportion of the front end edge. This prevents occurrence of warping, thus further ensuring airtightness.

The present invention has been specifically described based on the embodiment above. The present invention is not limited to the above-described embodiment. For example, in the above-described embodiment, the concave portion 5 internally houses the inside dish 7 filled with the cosmetic material M as a particularly preferred embodiment. The present invention is applicable to a cosmetic container where the inside of the concave portion 5 is directly filled with the cosmetic material M for housing the cosmetic material M.

While in the above-described embodiment the convex portion 32 disposed on the outer peripheral surface of the shaft portion 31 of the supporting portion 29 and the concave portion 33 disposed on the inner peripheral surface of the end portion 18 of the turning portion 15 constitute the stopper, the convex shape and the concave shape may be switched.

In the above-described embodiment, as a particularly preferred embodiment, the elastic body 9 is disposed in the peripheral area of the concave portion 5 of the container main body 1 and the resin projection 14 is disposed in the portion of the cover 2 corresponding to the elastic body 9 so as to ensure airtightness. For example, reversely, the resin projection may be disposed in the peripheral area of the concave portion 5 of the container main body 1 and the elastic body 9 may be disposed in the portion of the cover 2 corresponding to the resin projection. Additionally, both of them may employ the elastic body 9. In short, the respective close-contact portions only needs to be disposed in the peripheral area of the concave portion 5 and the portion of the cover 2 corresponding to this peripheral area, be brought into contact with each other when the cover 2 is closed with respect to the container main body 1 so as to seal the inside, and include at least one of the close-contact portions constituted by an elastic body.

Furthermore, in the above-described embodiment, the cover 2 includes the turning portion 15 and the container main body 1 includes the concave portion 16, the concave portion 20, the projecting portion 21, the top surface 26 that is the opening-operation auxiliary portion, and similar member. Reversely, the cover 2 may include the concave portion 16, the concave portion 20, the projecting portion 21, the opening-operation auxiliary portion, and similar member and the container main body 1 may include the turning portion 15. In this case, the cover-side opening-operation auxiliary portion abutting on the turning-portion opening-operation auxiliary portion 27 of the turning portion 15 is set to the inferior surface of the cover 2. In this case, the user can hold and turning the turning portion 15 downward so as to release the engagement between the engagement parts 23 and 24, and can continue holding and turning the turning portion 15 such that the turning-portion opening-operation auxiliary portion 27 of the turning portion 15 abuts on the inferior surface of the cover 2 to be the opening-operation auxiliary portion of the cover 2 so as to press up this cover 2. When opening the cover 2, the cover 2 is held with the turning portion 15 released so as to pull up this cover 2.

What is claimed is:

1. A cosmetic container, comprising:

a container main body that includes a housing portion configured to house a cosmetic material;

a cover openable and closeable with respect to the container main body, the cover being configured to keep an inside of the container main body airtight;

a hinge that couples a rear end side of the container main body and a rear end side of the cover together, the hinge being used for opening and closing the cover with respect to the container main body; and a container main body-side close-contact portion and a cover-side close-contact portion disposed in respective portions of a peripheral area of the housing portion and a portion of the cover corresponding to the peripheral area, the container main body-side close-contact portion and the cover-side close-contact portion sealing the inside of the container main body and the cover in close contact with one another while the cover is closed with respect to the container main body, at least one of the container main body-side close-contact portion and the cover-side close-contact portion being made of an elastic body, wherein the cover has a turning portion on a front end side of the cover, the turning portion being rotatable around one axis along a front end edge of the cover, the turning portion includes:

a turning-portion engagement part that engages with an engagement part disposed at the container main body when the turning portion is turned in a closing direction so as to close the cover and releases the engagement with the engagement part when the turning portion is turned in an opening direction; and a turning-portion opening-operation auxiliary portion that is rotatable about a shaft portion of the cover, the turning-portion opening-operation auxiliary portion abuts on an opening-operation auxiliary portion disposed at the container main body so as to press up the cover using a principle of a lever when the turning portion is further turned in the opening direction after the engagement between the engagement parts is released.

2. The cosmetic container according to claim 1, wherein the turning portion is rotatably attached to the cover.

3. The cosmetic container according to claim 1, wherein the close-contact portions are in close contact with one another in a radial direction of the housing portion.

4. The cosmetic container according to claim 2, wherein the close-contact portions are in close contact with one another in a radial direction of the housing portion.

5. The cosmetic container according to claim 1, further comprising a stopper configured to catch the turning portion not to turn downward when the cover is closed from an opening state.

6. The cosmetic container according to claim 2, further comprising a stopper configured to catch the turning portion not to turn downward when the cover is closed from an opening state.

7. The cosmetic container according to claim 3, further comprising a stopper configured to catch the turning portion not to turn downward when the cover is closed from an opening state.

8. The cosmetic container according to claim 4, further comprising a stopper configured to catch the turning portion not to turn downward when the cover is closed from an opening state.

9. The cosmetic container according to claim 1, further comprising:

a main body concave portion formed in a front end of the container main body, wherein the turning-portion engagement part is disposed within the main body concave portion when the cover is closed, and the turning-portion engagement part is removed from the main body concave portion when the cover is opened by the turning portion.

* * * * *